US006122997A

United States Patent [19]

Altura

[11] Patent Number: 6,122,997

[45] Date of Patent: Sep. 26, 2000

[54] ADAPTER FOR PRECISE TIGHTENING OF FLUID TUBE FITTINGS

[76] Inventor: Dan Altura, 920 N. Formosa Ave., Los Angeles, Calif. 90046

[21] Appl. No.: 08/296,815

[22] Filed: Aug. 26, 1994

[51] Int. Cl.[7] ..... B25B 13/00

[52] U.S. Cl. ..... 81/124.2; 81/90.3; 81/119

[58] Field of Search ..... 81/124.2, 120, 81/119, 124.3, 124.6, 121.1, 176.15, 176.2, 176.3, 90.1, 90.3, 90.5, 90.7, 90.9

[56] References Cited

U.S. PATENT DOCUMENTS

| | | | |
|---|---|---|---|
| 174,486 | 3/1876 | Collingsworth | 81/124.2 |
| 674,914 | 5/1901 | Gansley | 81/124.2 |
| 3,010,346 | 11/1961 | Kulp | 81/124.2 |
| 4,393,583 | 7/1983 | Zwald | 81/124.2 |
| 4,512,219 | 4/1985 | Janssen | 81/124.2 |
| 4,573,378 | 3/1986 | McDonald | 81/119 |
| 4,724,731 | 2/1988 | Onofrio | 81/119 |
| 4,757,729 | 7/1988 | Martinmaas | 81/90.3 |
| 4,945,791 | 8/1990 | Herschler et al. | 81/124.3 |

*Primary Examiner*—Willis Little

*Attorney, Agent, or Firm*—Erik M. Arnhem

[57] ABSTRACT

An adapter is provided which makes tightening fittings in miniature fluid flow systems, such as liquid chromatography and flow injection analysis, more precise. Current methods for tightening miniature fittings involve either finger tightening by itself or using a miniature wrench after finger tightening. These methods can lead to wide variations in the amount of torque applied to the fittings, due to differences in the strength and coordination from one person to the next. Over-tightening or undertightening can lead to leaks in these high pressure systems or can result in damage of expensive fluid components such as pumps or valves. The present adapter can be used with any standard torque wrench or torque screwdriver to precisely indicate the amount of torque being applied to these special fittings. Ordinary drive sockets cannot be used with fluid flow systems because the socket interferes with the tubing which protrudes from the fittings being tightened. The present adapter overcomes this problem by affording a recessed design which allows the tubing to protrude through the side of the adapter, thereby allowing the torque screwdriver or wrench to still be rotated a fraction of a complete turn, and allowing the fitting to be tightened to the required torque valve.

3 Claims, 2 Drawing Sheets

ADAPTER FOR PRECISE TIGHTENING OF FLUID TUBE FITTINGS

BACKGROUND OF THE INVENTION

1. Field of The Invention

This invention relates to an adapter used between a turning implement and a fluid tube fitting, whereby the fitting can be tightened to a precise torque setting.

2. Prior Developments

In the fields of high performance liquid chromatography and flow injection analysis miniature plumbing systems incorporating miniature fittings and small bore tubing are used to interconnect such components as pumps, valves, chromatography columns, and detectors. The tubing is secured, using special miniature fittings which usually consist of a hollow threaded screw and a ferrule. The ferrule fits onto the tubing, and as the hollow screw is tightened the ferrule is compressed into the associated cavity, which compresses the ferrule onto the tubing, forming a leaktight seal at pressures up to 10,000 psi. The hollow screw needs to be tightened to adequately compress the ferrule, giving a tight seal around the tubing and forming a leaktight connection between the miniature tubing and the component that is being plumbed to the tubing. If the hollow screw is not tightened enough, inadequate compression of the ferrule occurs allowing fluid to leak from the tubing-body interface. If the hollow screw is tightened too much, damage can occur to the screw threads or the head of the screw can break off leading to damage to the fluid component. Another problem called fluid premixing can also occur, which can compromise the analytical results.

In order to tighten the hollow screw or nut two methods are used. The traditional method involves hand tightening the fitting and then turning the screw an additional fraction of a turn with a wrench. The second technique utilizes plastic fittings with special ferrules which need only to be finger tightened to give a leak free seal up to several thousand psi. The problem with both of these methods is that the exact amount of torque applied when the hollow screw is tightened is not reproducible since the amount of torque that is applied by the human hand can vary, depending on the strength and manual dexterity of the user. Wrench tightening, which requires rotating a wrench a certain fraction of a turn using the naked eye, is also only approximate and can vary from user to user. Since the torque applied is directly related to the amount of compression of the ferrule onto the tubing, the compression also becomes irreproducible.

Commercially available turning implements have torque gauges built into the implement. Such implements come in either the form of a screwdriver or wrench, and use drive sockets or screwdriver bits for applying torque. Torque wrenches are used for higher torque applications while torque screwdrivers are usually used for low torque application. Neither a torque screwdriver or torque wrench can be used with miniature plumbing fittings since the tubing protruding from the end of the hollow screw would interface with the socket on the screwdriver or wrench.

The present invention eliminates the problem of protruding tubing by offering specially designed adapters which can grasp onto all common types of miniature fittings without interfering with the protruding tubing. The essence of the invention is the design of these fixtures which can accomodate a variety of torque adjustment devices such as a torque gauge screwdriver, torque wrench, and torque limiting screwdrivers and wrenches. The adapters can be used with both hand tightened and wrench tightened chromatography fittings, and to thus give the user the ability to accurately measure and apply torque to these various fittings used in high performance liquid chromatography and flow injection analysis.

SUMMARY OF THE INVENTION

In one particular embodiment, the invention comprises an adapter usable between a turning implement equipped with a torque indicator, and a hollow threaded fitting for a flexible fluid tube, wherein the fitting has an exposed flange and a flexible tube extending through the flange into the area proximate to the fitting. The adapter is especially designed to fit onto the flange of the hollow fitting without interference by the protruding tubing. The adapter is, at the same time, designed to fit on conventional turning implements equipped with torque indicators, e.g. torque wrenches and torque screwdrivers.

The adapter of the invention was particularly developed to facilitate the accurate tightening of miniature threaded fittings used in high performance liquid chromatography and flow injection analysis. The term "accurate tightening" is here used to refer to precise torque values obtained by using conventional torque wrences or torque screwdrivers, as opposed to the less precise torque values obtained by hand tightening or conventional end wrenches.

The adapters of the present invention preferably comprise a rotary drive element having a clutch surface adapted to mate with the output end of a torque wrench or screwdriver, and at least two elongated prongs extending axially from the drive element to grip the flange of a hollow fitting used to mount a flexible fluid tube. The prongs have elongated side surfaces that are bare and unconnected, such that the adapter can be plugged onto the flange of the hollow fitting without striking or abutting the exposed portion of the fluid tube.

The adapter is designed so that the prongs can be rotated through limited arcuate distances without interference from the tubing. The adapter is usable with conventional torque wrenches or torque screwdrivers, to obtain a precise and accurate torque valve on the tightened fitting.

THE DRAWINGS

FIG. 1 longitudinal sectional view taken through an adapter constructed according to the invention. FIG. 1 is taken on line 1—1 in FIG. 2.

DESCRIPTION OF PREFERRED EMBODIMENTS OF THE INVENTION

Figure 1:
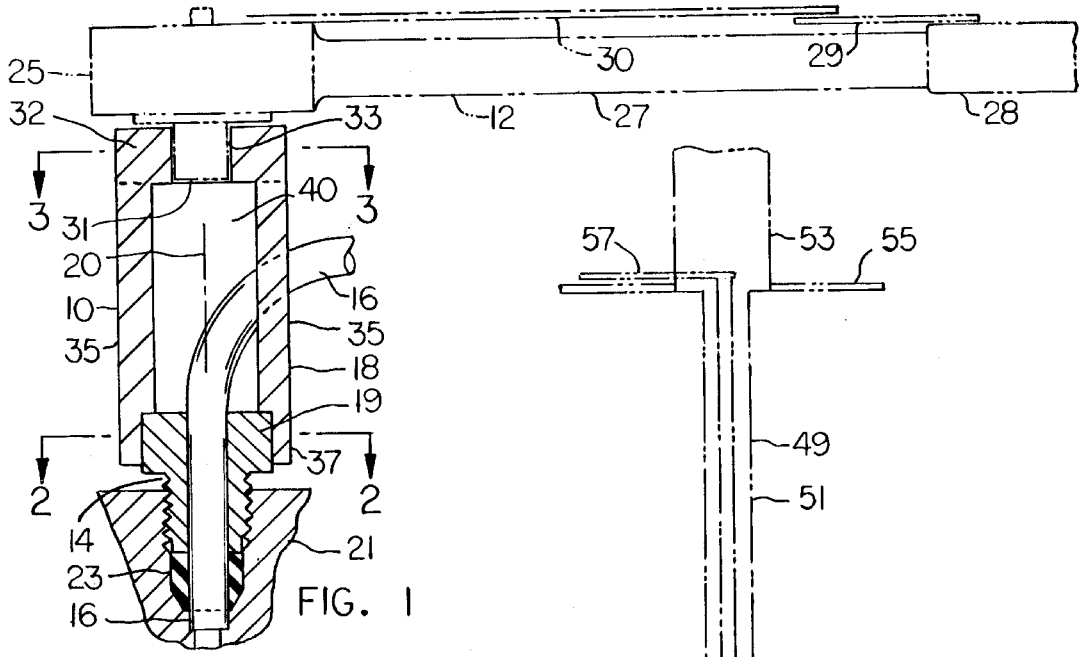
Figure 2:
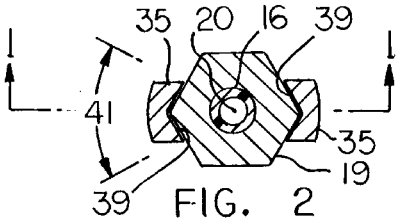
FIG. 2 is a transverse sectional view taken on line 2—2 in FIG. 1.
Figure 3:
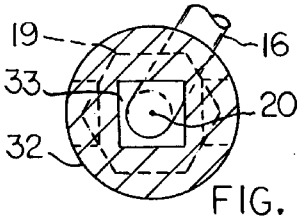
FIG. 3 is a transverse sectional view taken on line 3—3 in FIG. 1.

Referring to FIGS. 1 through 3, there is shown an adapter 10 operatively positioned between a conventional torque wrench 12 and a conventional hollow fitting 14 for a flexible tube 16. Normally tube 16 is formed out of plastic, e.g. polyethylene.

Fitting 14 comprises a hollow (annular) body 18 having a threaded side surface and a flange 19. As shown in FIG. 2, flange 19 has a hexagonal profile in the transverse plane, i.e. a plane transverse to the rotational axis of the fitting. In the drawings the rotational axis of the fitting is designated by numeral 20.

Fitting 14 threads into a fluid component 21 to apply axial pressure on a ferrule 23 surrounding an end portion of tube 16. Axial pressure on the ferrule causes the ferrule material to exert radial pressures on tube 16 and the side surface of the cavity in component 21, thereby providing a liquid tight seal at relatively high fluid pressures, e.g. up to about 10,000 p.s.i. Ferrule 23 can be formed of various deformable materials, e.g. a deformable metal or a high durometer elastomer. Ferrule 23 acts as a seal element between tube 16 and component 21.

The aforementioned torque wrench 12 can be a conventional structure, comprising a head 25 containing a ratchet mechanism, an elongated relatively thin shaft 27, and a handle 28. A scale plate 29 is attached to the handle, and an elongated pointer 30 is attached to head 25, such that when the torque wrench is turned to apply a turning force the thin shaft 27 bends slightly under the reaction force, thereby producing a deflection of the shaft 27. The deflection is proportional to the resistance torque of the threaded connection, and is visually indicated on scale plate 29.

The torque wrench includes a rotary output plug 31 having a square cross section (transverse to rotation axis 20). Adapter body 10 comprises a relatively thick circular end wall 32 having a square opening 33 adapted to mate with plug 31 of the torque wrench. Typically, the opening 33 will be about three eighth inch on a side, whereby the opening fits a standard size torque wrench output member. Opening 33 constitutes a clutch surface centered on rotational axis 20.

The adapter body further comprises two elongated prongs 35 extending from end wall 32 parallel to axis 20. Each prong has a terminal end 37 adapted to grip the exposed flange 19 on fitting 14, whereby rotation of the adapter by turning implement 12 tightens the threaded fitting 14 to a torque value indicated on scale plate 29.

As viewed in FIG. 2, prongs 35 have facing V-shaped recesses 39 in their terminal ends 37, to establish a good grip of the adapter on hexagonal flange 19. The prongs can drive the fitting in either direction, clockwise or counterclockwise, thereby permitting back-and-forth adjustments of the fitting to a precise torque setting, as indicated on scale plate 29.

A major feature of the invention is the prong construction, wherein the elongated side surfaces of the prongs are bare and devoid of connection to the end wall 32 or other tying devices. The prongs are cantilever devices that can be positioned against the corners (edges) of flange 19 without striking or hitting the protruding flexible tube 16. The tube is undisturbed by placement of the adapter on flange 19.

Prongs 35 are integral with end wall 32, either by casting, welding or machining processes. Each prong is preferably substantially longer than the diameter of circular end wall 32 so that a vacant space 40, of considerable axial length is established within the space circumscribed by the prongs. Typically end wall 32 will have a diameter of about one and one fourth inch; each prong 35 will have an axial length between two inch and two and one half inch. The elongated vacant space 40 accommodates the flexible tube 16, with minimal bending of the tube and without any kinking of the tube wall. The flexible tube can have its non-illustrated end connected to another component without hampering the action of adapter 10.

The illustrated prong arrangement is somewhat similar to a wrench arrangement depicted in U.S. Pat. No. 2,522,038, except that in the present arrangement the prongs are entirely separate and unconnected so as to have unobstructed length dimensions of considerable axial extent, e.g. at least two inches. In the wrench of U.S. Pat. No. 2,522,038 the prongs are connected proximate their terminal ends by an annular band or ring. The ring obstructs the spaces between the prongs so that the flexible conductors 42 (in U.S. Pat. No. 2,522,038) have to have free ends in order to place the wrench on the threaded fitting. The wrench system of U.S. Pat. No. 2,522,038 cannot be used with flexible tubes whose ends are connected to other structures.

As shown in FIG. 2, each prong 35 is a bar having a transverse thickness dimension 41 measuring about fifty five degrees in a circumferential direction around rotational axis 20. The prongs (bars) are relatively rigid and strong, while still permitting extensive rotational motion of the adapter body before any contact is made with tube 16.

The adapter is normally used only during the final phase of the tightening process. Fitting 14 is threaded into component 21 to a finger-tight status, either by hand or by a conventional open end wrench. Adapter 10 and torque wrench 12 are used to establish a precise final torque setting on the thread grip force. Normally the torque wrench can achieve a precise torque reading after less than one complete revolution of the adapter. The adapter can be removed from the fitting and reinstalled during the final tightening process, in order to avoid twisting or disturbing the flexible tube 16.

Figure 6:
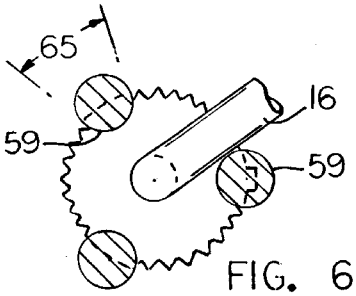
FIG. 6 is a transverse sectional view taken on line 6—6 in FIG. 4.
Figure 4:
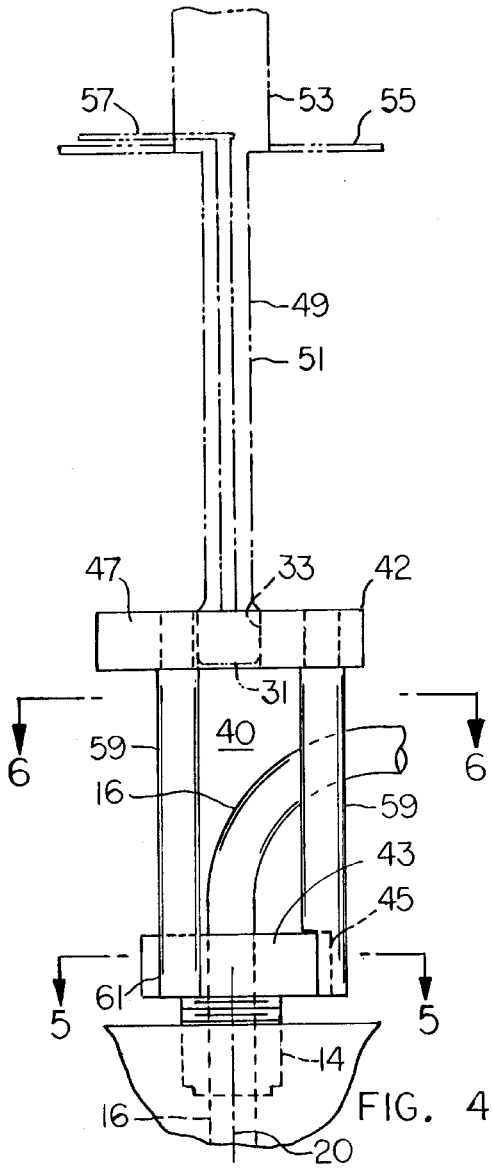
FIG. 4 is an elevational view of another adapter embodying the invention.
Figure 5:
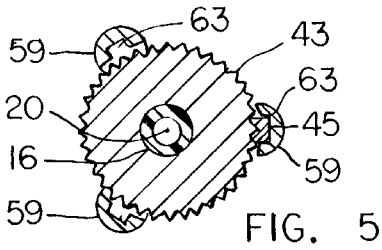
FIG. 5 is a transverse sectional view taken on line 5—5 in FIG. 4

The adapter shown in FIGS. 1 through 3 is used with fittings having hexagonal flanges. FIGS. 4 through 6 illustrate an adapter 42 usable with a fitting having a circular serrated flange or knob 43 that is conventional, except that a drive lug 45 has been welded or otherwise affixed to the edge of the serrated flange.

The adapter comprises an end wall 47 having a square opening 33 therein adapted to mate with a square plug 31 on a conventional torque screwdriver 49. The screwdriver comprises a thin hollow shaft 51 connected to a handle 53. The handle carries a dial plate 55 that registers with a pointer 57 connected to plug 31. During a tightening (turning) operation shaft 51 undergoes a torsional twist that is indicated by pointer 57. The action is similar to the action of the above-described torque wrench, in that the final torque setting is visually indicated on a dial plate.

Adapter 42 comprises three prongs 59 extending from wall 47 parallel to the rotational axis 20. The terminal ends 61 of the prongs are recessed as at 63 to grip the drive lug 45. For reasons of economy, only one lug is provided on flange 43. Thus, only one of the recesses 63 is used at any one time. However, the other two recesses come into play, should the adapter be reoriented on the fitting (to provide clearance for the flexible tube).

When only one drive lug 45 is used, two of the prongs 59 act as stabilizing devices, while the prong engaged with the lug 45 provides the driving (turning) force. In the adapter of FIGS. 4 through 6, each prong is a circular rod welded or otherwise affixed to end wall 47. As in the construction of FIGS. 1 through 3, the axial length of each prong is substantially greater than the diameter of end wall 47, to provide a central vacant space 40 having a substantial axial dimension. Each circular rod has a transverse thickness dimension 65 that is about thirty five degrees measured in a circumferential direction around rotational axis 20. The adapter can be rotated an appreciable arcuate distance prior to coming into contact with the flexible tube 16.

The adapter of FIGS. 4 through 6 functions similarly to the adapter of FIGS. 1 through 3, except that it is used with a fitting that has a circular serrated flange (rather than a a hexagonal flange). Either adapter can be used with a torque wrench or torque screwdriver of conventional design.

Figure 7:
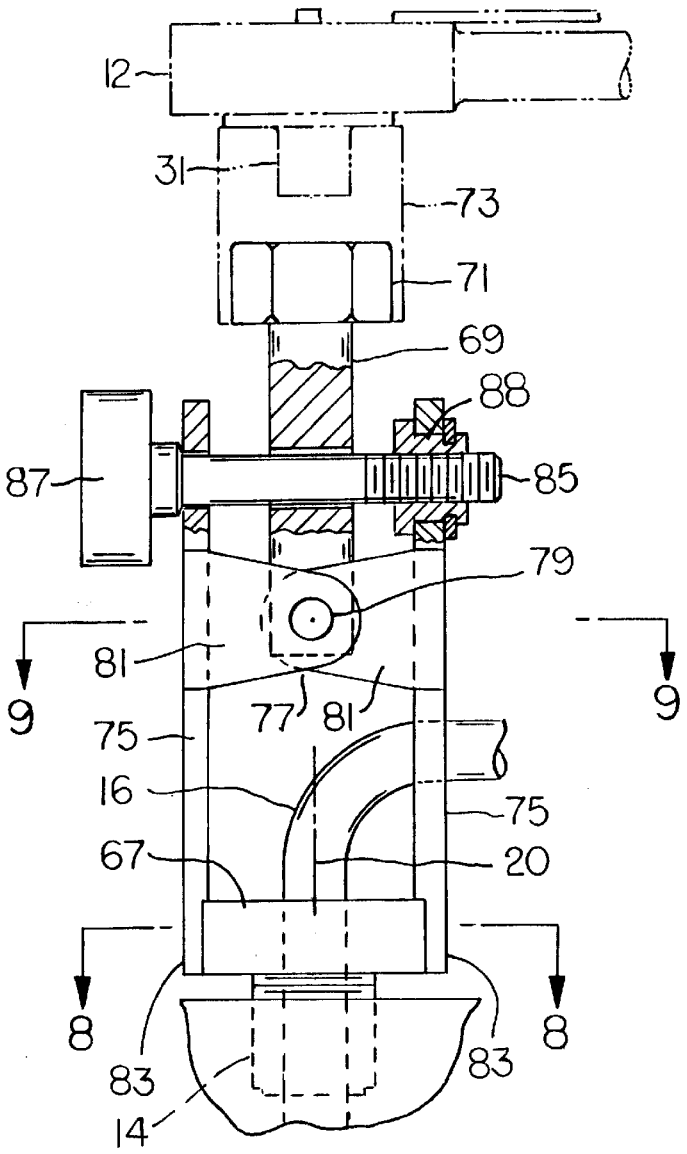
FIG. 7 is an elevational view of a further adapter utilizing features of the present invention. Fragmentary portions of the adapter are sectioned to show interior details.
Figure 9:
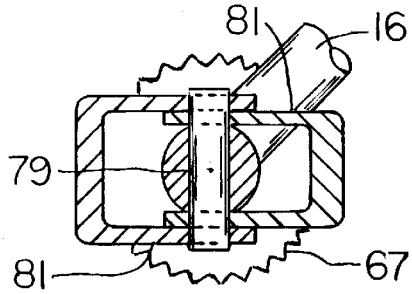
FIG. 9 is a transverse sectional view taken on line 9—9 in FIG. 7.
Figure 8:
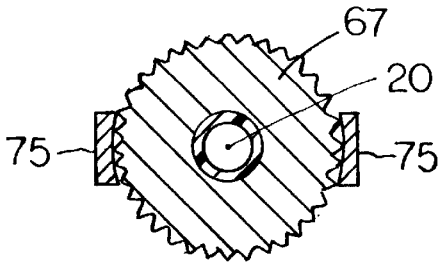
FIG. 8 is a transverse sectional view taken on line 8—8 in FIG. 7.

FIGS. 7 through 9 show an adapter usable with a fitting having a serrated circular flange 67 (similar to flange 43 shown in FIGS. 4 through 6, except that it has no drive lug 45).

The adapter of FIG. 7 comprises a rotary drive element 69 in the form of an axially extending bar 70 having a hexagonal cross-sectioned head 71 sized to fit into a conventional socket 73 mated with square plug 31 on the torque wrench 12. Socket 73 is a conventional component normally used with torque wrenches (or socket wrenches).

Bar 70 is connected to axially extending prongs 75 by a pivot means designated generally by numeral 77. The pivot means comprises a transverse pin 79 press fit in bar 70 to form a swivel mount for two sets of arms 81 extending from prongs 75. The prongs can thereby be swingably adjusted so that the terminal ends 83 of the prongs can be tightened or loosened on the serrated flange 67 of the hollow fitting.

The tightening or loosening force is provided by a manual screw 85 having a manual knob 87. The screw extends through a transverse hole in bar 70, so that its threaded end is in mesh with nut 88 loosely captured within a non-circular opening in the rightmost prong 75. Knob 87 can be manually rotated to tighten or loosen the grip of prongs 75 on the flange of hollow fitting 14.

The action of prongs 75 is generally similar to the action of the corresponding prongs in the adapters shown in FIGS. 1 and 4. However, prongs 75 offer an advantage in that they are usable with fittings having circular flanges equipped with serrated edges. Such fittings are commonly tightened by hand. The adapter of FIG. 7 provides a method for achieving a greater and more precise torque setting than can be achieved with manual (finger) tightening procedures.

From the above descriptions, it will be realized that the invention can be embodied in various forms and configurations.

What is claimed is:

1. An adapter usable between a turning implement equipped with a torque indicator and a hollow threaded fitting for establishing a pressure seal around a flexible fluid tube; wherein the fitting has an exposed flange and the flexible tube extends axially from said flange;

said adapter comprising:

a rotary drive element having a rotational axis and a non-circular clutch surface centered on said axis, said clutch surface being matable with a turning implement, whereby the turning implement can be manually operated to rotate said drive element around said rotational axis;

and at least two prongs extending from said drive element parallel to said rotational axis; said prongs having terminal ends spaced apart for gripping the exposed flange of the hollow fitting, whereby rotation of said turning implement tightens the threaded fitting to a torque valve indicated on the turning implement;

said prongs having elongated side surfaces that are bare, whereby the spaces between the prongs are enabled to freely accept the aforementioned flexible tube during placement of the prongs on the flange of the hollow fitting;

said prongs being spaced apart by a predetermined distance related to the diametrical dimension of the flange on the fitting;

each prong having an axial length that is at least twice the distance between the prongs, whereby an axially elongated vacant zone is established within the space circumscribed by the prongs;

the entire prong length being unobstructed so that the prongs can freely pass across the flexible tube during placement of the adapter on the hollow fitting;

each prong having a transverse thickness that is less than sixty degrees measured in a circumferential direction around the drive element rotational axis, whereby the adapter can be rotated through a substantial arc prior to coming into contact with the flexible tube.

2. The adapter of claim 1 wherein there are two parallel prongs.

3. The adapter of claim 1 wherein there are three equidistantly spaced parallel prongs.

* * * * *